United States Patent [19]

Partington et al.

[11] Patent Number: 4,767,247

[45] Date of Patent: Aug. 30, 1988

[54] APPARATUS AND METHOD FOR PREVENTING RELATIVE BLADE MOTION IN STEAM TURBINE

[75] Inventors: Albert J. Partington, Winter Springs, Fla.; Anthony Hodgson, Charlotte, N.C.

[73] Assignee: Westinghouse Electric Corp., Pittsburgh, Pa.

[21] Appl. No.: 18,321

[22] Filed: Feb. 24, 1987

[51] Int. Cl.[4] ..... F01D 5/32

[52] U.S. Cl. ..... 416/193 A; 416/220 R; 416/221; 416/500

[58] Field of Search ..... 416/193 A, 220 R, 221, 416/500

[56] References Cited

U.S. PATENT DOCUMENTS

| | | | |
|---|---|---|---|
| 2,843,356 | 7/1958 | Hull | 416/220 R |
| 2,867,408 | 1/1959 | Kolb et al. | 416/193 A X |
| 2,912,223 | 11/1959 | Hull | 416/221 |
| 3,001,760 | 9/1961 | Guernsey et al. | 416/193 A X |
| 3,037,741 | 6/1962 | Tuft | 416/193 A X |
| 3,202,398 | 8/1965 | Webb | 416/193 A X |
| 3,761,200 | 9/1973 | Gardiner | 416/193 A X |
| 4,022,545 | 5/1977 | Shank | 416/221 |
| 4,457,668 | 7/1984 | Hallinger | 416/193 A |
| 4,533,298 | 8/1985 | Partington et al. | 416/191 |
| 4,602,412 | 7/1986 | Partington et al. | 29/156.8 B |
| 4,676,723 | 6/1987 | Kiger et al. | 416/221 |

FOREIGN PATENT DOCUMENTS

| | | | |
|---|---|---|---|
| 1112993 | 8/1961 | Fed. Rep. of Germany | 416/193 A |
| 1204858 | 8/1959 | France | 416/193 A |
| 130710 | 10/1979 | Japan | 416/193 A |
| 313027 | 4/1956 | Switzerland | 416/193 A |
| 1339485 | 12/1973 | United Kingdom | 416/220 R |
| 2112466 | 7/1983 | United Kingdom | 416/193 A |

*Primary Examiner*—Everette A. Powell, Jr.

[57] ABSTRACT

A steam turbine of the type employing axial entry blades is provided with a plurality of generally tangentially oriented slots in the rotor steeples. Resilient, deformable pins are driven into the slots under the blade platforms so as to urge the blade roots radially outward.

25 Claims, 2 Drawing Sheets

APPARATUS AND METHOD FOR PREVENTING RELATIVE BLADE MOTION IN STEAM TURBINE

BACKGROUND OF THE INVENTION

1. Field of the Invention

The present invention generally relates to steam turbines. More specifically, the present invention relates to an apparatus and method for reducing relative motion between the blades of the turbine and the rotor, especially during turning gear operation. The present invention has particular application to steam turbines of the type employing "axial entry" blades, but is not limited thereto.

2. Description of the Prior Art

Steam turbines of the type employing "axial entry" blades comprise a rotor having a plurality of generally fir tree shaped generally axially extending grooves, with the blades circularly disposed therearound. Each blade has a generally fir tree-shaped root at a proximal end thereof for registration with one of the grooves and a shroud integral with the blade at a distal end thereof. During normal operation, under load, centrifigal force holds the blade roots tight in the grooves with which they register. During turning gear operation however, the centrifigal force is insufficient to hold the blade roots tight in their grooves and hence the blades "flop", i.e., the blade roots rock circumferentially and axially in the grooves. This relative motion between the blade root and the rotor grooves may cause fretting of the root.

Blade "flop" may aggravate other problems. For example, "axial entry, integral shroud" blades are often used in the first rows of some turbines because they are more reliable than riveted shrouds. Usually, the shrouds are tightly butted, but in certain rows a small gap is intentionally provided between adjacent shrouds to allow for thermal expansion. Faces of the shrouds may wear from snubbing that occurs as a result of blade "flop.

It is known that certain steam turbines manufactured by Brown Boveri Corporation incorporate a means intended to solve this problem. That means comprises coil springs disposed in a plurality of radially oriented holes in the bottom of each root. It is believed that the intent of the coil spring is to urge the root radially outward against the edges of the goove to prevent relative motion between the root and groove. This solution, however, is considered undesirable because it is mechanically complicated and further because the radially oriented holes weaken the root. Further, the amount of force that can be exerted by the coil springs is limited by the size of the hole that can be machined in the root, and also by the size of the spring.

The assignee of the present application has implemented two other prior art means for solving this problem. The first is to drive shims between the bottom-most portion of each root and the bottom of the groove with which that root registers. The second is to cement each root in its respective groove with an adhesive such as Loctite®. The problem with these solutions is that disassembly of the turbine is made difficult and time consuming.

It is therefore desirable to provide an apparatus and method for reducing blade "flop" which is simple, inexpensive, reliable and easy to implement.

SUMMARY OF THE INVENTION

An apparatus for reducing blade flop comprises wedge means disposed between the platforms of each blade and the steeples with which the platforms are juxtaposed. An interference fit is provided between the wedge means and the platforms so that the wedge means urge the roots radially outward against the edges of the grooves. According to the preferred embodiment of the invention, the wedge means comprise a pair of motion restraint pins that reside in generally tangentially extending slots disposed in opposing ones of the steeples with which each platform is juxtaposed. The motion restraint pins are preferably resilient and deformable and constructed of stainless steel. Each motion restraint pin has a leading chamfered edge to permit ease of installation. The motion restraint pins may take one of a number of different cross sectional shapes, including rectangular, square, semi-circular and generally C-shaped.

According to another embodiment of the invention, two pair of motion restraint pins are disposed between each platform and the steeples with which each platform is juxtaposed. Preferably, there is a first pair of motion restraint pins disposed adjacent a forward end of the platform and a second pair of motion restraint pins disposed adjacent a rearward end of the platform.

A method of assembling a turbine to incorporate the above-described apparatus is also disclosed.

Reference is made to commonly assigned co-pending application Ser. No. 18,320, filed 2-24-87 for a related but alternate solution to the problem addressed by this invention.

DESCRIPTION OF THE PREFERRED EMBODIMENT

Figure 1:
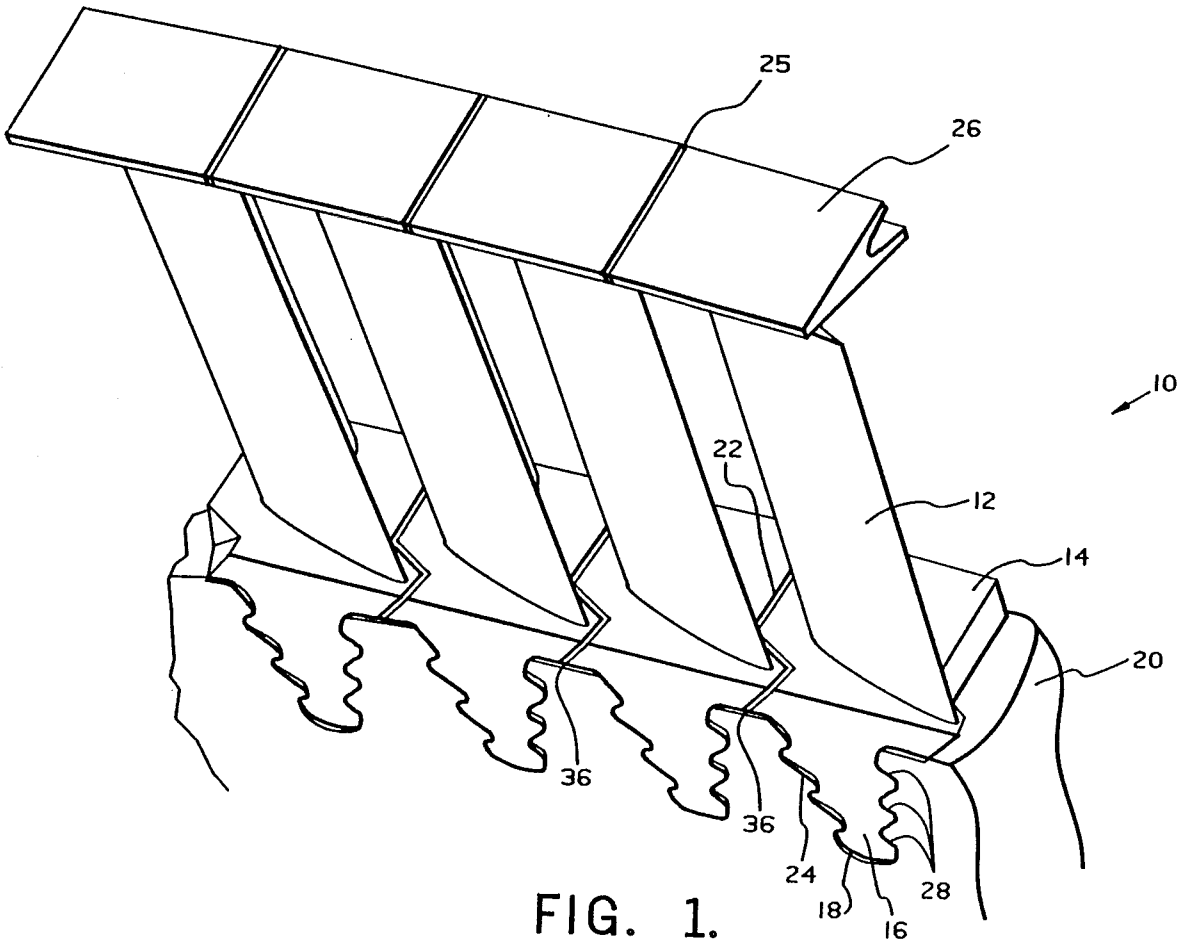
FIG. 1 is a perspective view of a section of a turbine.

Referring to the drawings, wherein like numerals represent like elements, there is illustrated in FIG. 1 a portion of a turbine labeled generally 10 comprising a rotor 20 and a plurality of blades 12. Each blade 12 comprises a platform 14 and a root 16 disposed at the proximal end thereof. The blade 12 may also comprise an integral shroud 26 at the distal end thereof, although the present invention is not limited in application to steam turbines of the type employing integral shroud blades. Thus, the present invention has application to steam turbines of the type employing free standing blades. The rotor 20 comprises a plurality of generally axially extending grooves 18 disposed therearound. As illustrated, each root 16 and each groove 18 have a generally fir tree shape and each root 16 is in registration with one of the grooves 18. Disposed between adjacent grooves 18 are steeples 36. As shown, the platform 14 of each blade is juxtaposed a pair of steeples.

As also illustrated in FIG. 1, there may be a small clearance 22 between adjacent platforms 14 which may open further under hot rotor conditions. There may also be a small clearance 24 between each root 16 and the blade 18 with which it registers. Still further, there may be a small clearance 25 between adjacent shrouds 26 which may also open under hot rotor conditions. The existence of these clearances may result in blade "flop" during turning gear operation. Still further, if the blades 12 are of the type that employ integral shrouds 26, opposing faces of the shrouds 26 may wear from snubbing.

Figure 2:
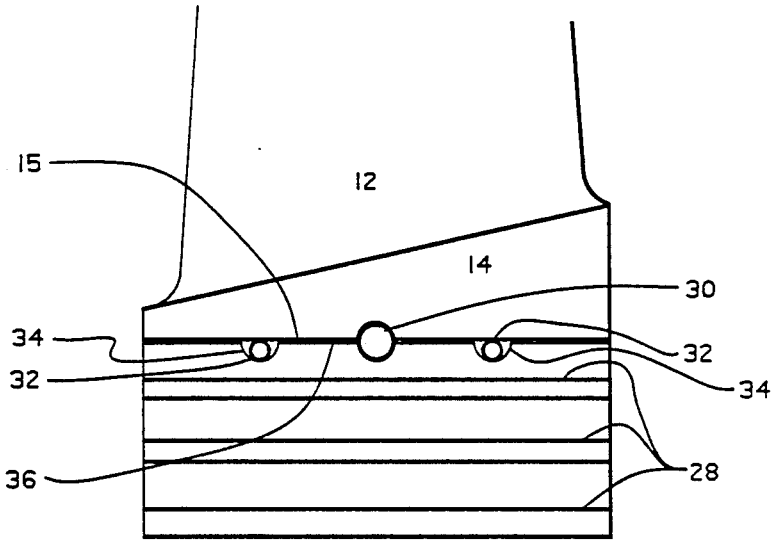
FIG. 2 is a side plan view of an axial entry blade of the type having a generally fir tree shaped root.

Referring now to FIG. 2, there are illustrated further details of the turbine. As is common in steam turbines employing axial entry blades, each blade 12 is provided with a lock pin 30 that prevents the blade from moving in the axial direction of the rotor. The lock pin 30 is disposed between the platform 14 and one of the steeples 36 with which the platform 14 is juxtaposed. The lock pin 30 resides in a generally tangentially extending slot in the steeple and an aligned slot in the platform. As illustrated, the lock pin 30 is generally centrally disposed between front and rear ends of the platform. What has been described thus far is well known in the art.

Figure 5:
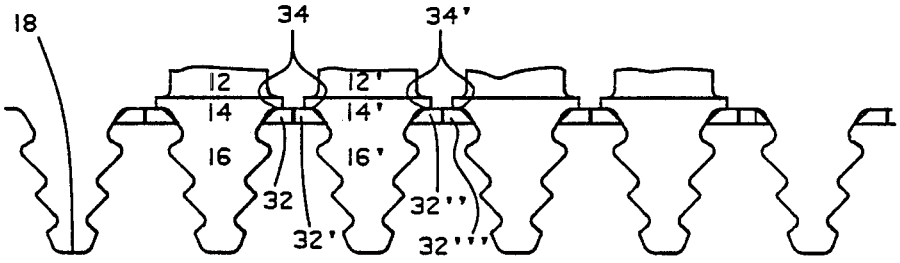
FIG. 5 illustrates a portion of a turbine equipped with the motion restraint pins of the present invention.

According to the invention, blade "flop" is reduced by wedge means 32 disposed between the base 15 of each platform 14 and the steeples 36 with which the platform 14 is juxtaposed. (See FIG. 2). Preferably, there is an interference fit between the wedge means 32 and the base 15 of platform 14 so that the wedge means 32 urge bearing lands 28 of the root 16 radially outward against edges of the groove 16. It is to be understood that the wedge means 32 should be provided on each side of the platform, as best illustrated in FIG. 5. Moreover, it should be understood that although FIG. 2 illustrates wedge means disposed on each of the front and rear ends of the platform (i.e,, forward and rearward of the lock pin 30), the invention is not limited thereto. Thus, the wedge means 32 need only be provided on one end of the platform.

According to the preferred practice of the invention, the wedge means 32 comprise resilient and deformable pins ("motion restraint pins") constructed of stainless steel. Preferably, the motion restraint pins 32 are constructed of ASTM A565 grade 616 material. As shown, the motion restraint pins 32 reside in generally tangentially extending slots 34 disposed in opposing ones of the steeples 36 with which each platform 14 is juxtaposed. See FIGS. 2 and 5. If only a single pair of motion restraint pins is utilized, the slots 34 and motion restraint pins 32 may be disposed either forward or rearward of the lock pin 30, one motion restraint pin 32 being disposed on each side of the platform as shown in FIG. 5. If it is desired to utilize two pair of motion restraint pins 32, they may be disposed both forward and rearward of the lock pin 30 as illustrated in FIG. 2.

Figure 3:
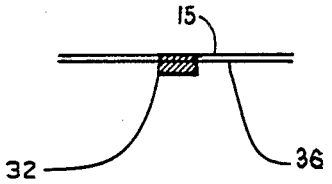
FIG. 3 is a detailed side plan view illustrating the cooperation between one of the motion restraint pins of the present invention and a blade platform.
Figure 4:
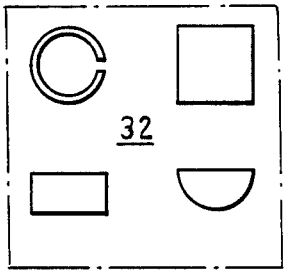
FIG. 4 illustrates various cross-sectional shapes that the motion restraint pins of the present invention may assume.

FIG. 4 illustrates various shapes that the motion restraint pins 32 may assume. Thus, the motion restraint pin may have a generally C-shaped cross section, a square cross section, a rectangular cross section, or a semi-circular cross section. It is preferred that the cross sectional shape of the slot 34 be substantially that of the cross sectional shape chosen for the motion restraint pin 32. It is also preferred that the cross sectional dimension (width or diameter) of the motion restraint pin 32 be substantially that of the slot 34 so that there is an interference fit between the motion restraint pins 32 and the base 15 of the platform 14. See FIG. 3.

It will be appreciated that the motion restraint pins urge the roots 16 radially outward. Thus, the motion restraint pins 32 urge bearing lands 28 of roots 16 against the edges of grooves 18, whereby blade flop is eliminated. It will also be appreciated that, if blades 12 employ integral shrouds 26, the motion restraint pins 32 will urge opposing faces of adjacent shrouds into abutment, whereby wear from snubbing is eliminated.

According to the invention, a method of assembling a turbine utilizing the motion restraint pins 32 comprises the following steps. Reference is made to FIG. 5.

A generally tangentially extending slot 34 is machined in each steeple at a location other than where the lock pin 30 is to be located. The root 16 of a blade 12 is then inserted into a groove 18 and the lock pin for the blade 12 is inserted. A motion restraint pin 32 is then inserted in the slot 34 and driven beneath the platform 14. Another motion restraint pin 32′ is then inserted in the slot 34 next to the motion restraint pin 32 previously driven under the platform 14. Then, the root 16′ of a blade 12′ is inserted in the next groove 18 in succession and its platform 14′ is driven over the motion restraint pin 32′. The lock pin 30 for the blade 12′ is then inserted. A motion restraint pin 32″ is inserted in the slot 34′ and driven beneath the platform 14′. A motion restraint pin 32‴ is inserted in the slot 34′, and so on until all blades in the row have been assembled.

It is preferred that a curved tool having a blunt end be utilized to drive the motion restraint pins beneath the platforms. Thus, the blunt end of the curved tool should be placed against the motion restraint pin and the motion restraint pin should be driven under the platform by hammering the other end of the tool.

The present invention may be embodied in other specific forms without departing from the spirit or essential attributes thereof and, accordingly, reference should be made to the appended claims, rather than to the foregoing specification, as indicating the scope of the invention.

I claim as my invention:

1. In a steam turbine of the type having a rotor with a plurality of generally axially extending grooves disposed therearound, a section of rotor between adjacent grooves defining steeples, a plurality of blades, each blade having a root in registration with one of the grooves and platform juxtaposed the steeples that are adjacent the groove with which the root registers, and means for locking each root in the groove with which it registers to prevent axial movement of the blade, an apparatus for preventing the root from rocking in the groove comprising wedge means disposed between each platform and the steeples with which the platform is juxtaposed, there being an interference fit between the wedge means and the platform so that the wedge means urges the root radially outward against edges of the groove.

2. Apparatus according to claim 1 wherein the wedge means comprises a pair of pins.

3. Apparatus according to claim 2 wherein the pins reside in generally tangentially extending slots disposed in opposing ones of the steeples with which each platform is juxtaposed.

4. Apparatus according to claim 3 comprising two pair of pins disposed between each platform and the steeples with which each platform is juxtaposed, there being a first pair disposed adjacent a forward end of the platform and a second pair disposed adjacent a rearward end of the platform, one of each pair being disposed on one side of the platform, the other of each pair being disposed on the other side of the platform.

5. Apparatus according to claim 3 wherein the pins have a generally semi-circular cross-section.

6. Apparatus according to claim 3 wherein the pins have a generally C-shaped cross-section.

7. Apparatus according to claim 3 wherein the pins have a generally rectangular cross-section.

8. Apparatus according to claim 3 wherein the pins have a generally square cross-section.

9. Apparatus according to claim 3 wherein the pins are resilient and deformable.

10. Apparatus according to claim 9 wherein the pins are constructed of stainless steel.

11. Apparatus according to claim 3 wherein the pins have a leading chamfered edge.

12. Steam turbine comprising:

(a) a rotor having a plurality of generally axially extending, generally fir tree shaped grooves disposed therearound, there being a section of the rotor between adjacent grooves defining steeples;

(b) a plurality of blades circularly disposed around the rotor, each blade having a generally fir tree shaped root in registration with one of the grooves and a platform juxtaposed the steeples that are adjacent the groove with which the root registers;

(c) a lock pin disposed between each platform and at least one of the steeples with which the platform is juxtaposed, there being a first generally tangentially extending slot in the steeple and an aligned slot in the platform in which the lock pin resides, the lock pin being generally centrally disposed between front and rear ends of the platform and preventing the blade from moving in the axial direction of the rotor; and (d) at least a pair of motion restraint pins disposed between each platform and the steeples with which each platform is juxtaposed, the pair of motion restraint pins residing in second generally tangentially extending slots disposed in opposing ones of the steeples with which each platform is juxtaposed, the second slots having a cross-sectional dimension substantially that of the motion restraint pins so that there is an interference fit between the motion restraint pins and the platform, the motion restraint pins urging the root radially outward against edges of the groove and thereby preventing the root from rocking in the groove.

13. Steam turbine according to claim 12 wherein the pair of motion restraint pins is disposed forward of the lock pin.

14. Steam turbine according to claim 12 wherein the pair of motion restraint pins is disposed rearward of the lock pin.

15. Steam turbine according to claim 12 comprising two pair of motion restrain pins disposed between each platform and the steeples with which each platform is juxtaposed, there being a first pair disposed forward of the lock pin and a second pair disposed rearward of the lock pin.

16. Steam turbine according to claim 12 wherein the motion restraint pins have a generally semi-circular cross-section.

17. Steam turbine according to claim 12 wherein the motion restraint pins have a generally rectangular cross-section.

18. Steam turbine according to claim 12 wherein the motion restraint pins have a generally square cross-section.

19. Steam turbine according to claim 12 wherein the motion restraint pins have a generally C-shaped cross-section.

20. Steam turbine according to claim 12 wherein the motion restraint pins are resilient and deformable.

21. Steam turbine according to claim 20 wherein the motion restraint pins are constructed of stainless steel.

22. Steam turbine according to claim 12 wherein each motion restraint pin has a leading, chamfered edge.

23. Steam turbine according to claim 12 wherein each blade has an integral shroud disposed on the distal end thereof, and the motion restraint pins urge opposing faces of adjacent shrouds into abutment.

24. In a steam turbine of the type having a rotor with a plurality of generally axially extending, generally fir-tree shaped grooves disposed therearound, a section of rotor between adjacent grooves defining steeples, a plurality of blades, each blade having a generally fir-tree shaped root in registration with one of the grooves and a platform juxtaposed the steeples that are adjacent the grooves with which the root registers, and a lock pin disposed between each platform and at least one of the steeples with which the platform is juxtaposed for preventing axial movement of the root, a method of assembling the turbine to prevent the root from rocking in the groove comprising the steps of:

(a) machining a generally tangentially extending slot in each steeple at a location other than where the lock pin is to be located;

(b) inserting the root of a blade into a groove;

(c) inserting the lock pin for the blade inserted in step (b);

(d) providing a plurality of motion restraint pins each having a cross-section substantially that of the slot so that, when inserted between the platform and the steeple, an interference fit will be provided between each motion restraint pin and the platform, thereby urging the root radially outward against edges of the groove;

(e) inserting a motion restraint pin in the slot machined in the steeple that is juxtaposed the platform of the blade inserted in step (b) and driving the motion restraint pin beneath the platform;

(f) inserting another motion restraint pin in the same slot as in step (e) next to the motion restraint pin inserted in step (e);

(g) inserting a root of a blade in the next groove in succession and driving the platform over the motion restraint pin inserted in step (f);

(h) inserting the lock pin for the blade inserted in step (g); and (i) repeating steps (e) through (h) until the turbine is assembled.

25. Method according to claim 24 further comprising the steps of:

(j) providing a curved tool having a blunt end; and (k) placing the blunt end of the tool against the motion restraint pin and driving the motion restraint pin under the platform by hammering the other end of the tool.

* * * * *